US006969573B2

(12) United States Patent
Bender et al.

(10) Patent No.: US 6,969,573 B2
(45) Date of Patent: Nov. 29, 2005

(54) BLUE DIODE LASER SENSITIVE PHOTORECEPTOR

(75) Inventors: Timothy P. Bender, Port Credit (CA); John F. Graham, Oakville (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/187,069

(22) Filed: Jun. 28, 2002

(65) Prior Publication Data

US 2004/0002013 A1 Jan. 1, 2004

(51) Int. Cl.[7] ..... G03G 5/047

(52) U.S. Cl. ..... 430/58.65; 430/58.6; 430/59.1; 430/59.4; 430/120; 430/126; 399/159

(58) Field of Search ..... 430/58.65, 58.6, 430/58.75, 58.8, 59.1, 59.4, 31, 120, 126, 59.5; 399/159

(56) References Cited

U.S. PATENT DOCUMENTS

| | | | | | |
|---|---|---|---|---|---|
| 4,066,455 | A | * | 1/1978 | Mey et al. | 430/58.65 |
| 4,410,616 | A | | 10/1983 | Griffiths et al. | |
| 4,999,809 | A | | 3/1991 | Schildkraut et al. | 365/106 |
| 5,405,709 | A | | 4/1995 | Littman et al. | 428/690 |
| 5,529,868 | A | * | 6/1996 | Mashimo et al. | 430/58.8 |
| 5,849,444 | A | * | 12/1998 | Kinoshita et al. | 430/58.35 |
| 5,876,887 | A | | 3/1999 | Chambers et al. | |
| 5,994,013 | A | * | 11/1999 | Levin et al. | 430/58.4 |
| 6,007,954 | A | * | 12/1999 | Visser et al. | 430/31 |
| 6,190,811 | B1 | * | 2/2001 | Tanaka et al. | 430/78 |
| 2002/0028400 | A1 | * | 3/2002 | Shimada et al. | 430/58.05 |

OTHER PUBLICATIONS

American Chemical Society (ACS) STN File Registry print-out dated Sep. 18, 2004.*

Diamond, A. S. ed, *Handbook of Imaging Materials*, Marcel Dekker Inc, NY (1991), pp 395–396.*

* cited by examiner

*Primary Examiner*—Janis L. Dote

(74) *Attorney, Agent, or Firm*—Eugene O. Palazzo and Fay, Sharpe, Fagan, Minnich & McKee, LLP

(57) ABSTRACT

An electrostatographic article including: a substrate; a charge generator layer overcoated on the substrate and which layer is sensitive to blue light; and a charge transport layer overcoated on the charge generator layer and which charge transport layer is transparent to blue light.

22 Claims, 2 Drawing Sheets

BIS(3,4-DIMETHYLPHENYL)-4-METHOXYPHENYL AMINE

BLUE DIODE LASER SENSITIVE PHOTORECEPTOR

REFERENCES

Attention is directed to commonly owned and assigned U.S. Pat. No. 6,352,810, issued on Mar. 5, 2002, and U.S. Pat. No. 6,207,334, issued on Mar. 27, 2001.

The disclosures of each the above mentioned copending applications are incorporated herein by reference in their entirety. The appropriate components and processes of these applications may be selected for the toners and processes of the present invention in embodiments thereof.

BACKGROUND

The present invention is generally directed to layered photoresponsive devices, and imaging apparatus and processes thereof. More specifically, the present invention relates to an improved layered photoresponsive device comprised generally of a transport layer and a photogenerating layer. The layered photoresponsive devices of the present invention are useful as imaging members in various electrostatographic imaging systems, including those systems wherein electrostatic latent images are formed on the imaging member. Additionally, the photoresponsive devices of the present invention can be selectively irradiated with blue light, for example, as generated by a known blue diode laser, to accomplish, for example, latent image formation by, for example, charged area development (CAD) or discharge area development (DAD) methodologies.

Numerous photoresponsive devices for electrostatographic imaging systems are known including selenium, selenium alloys, such as arsenic selenium alloys; layered inorganic photoresponsive, and layered organic devices. Examples of layered organic photoresponsive devices include those containing a charge transporting layer and a charge generating layer. Thus, for example, an illustrative layered organic photoresponsive device can be comprised of a conductive substrate, overcoated with a charge generator layer, which in turn is overcoated with a charge transport layer, and an optional overcoat layer overcoated on the charge transport layer. In a further "inverted" variation of this device, the charge transporter layer can be overcoated with the photogenerator layer or charge generator layer. Examples of generator layers that can be employed in these devices include, for example, charge generator materials such as selenium, cadmium sulfide, vanadyl phthalocyanine, x-metal free phthalocyanine, benzimidazole perylent (BZP), hydroxygallium phthalocyanine (HOGaPc), and trigonal selenium dispersed in binder resin, while examples of transport layers include dispersions of various diamines, reference for example, U.S. Pat. No. 4,265,990, the disclosure of which is incorporated herein by reference in its entirety.

There continues to be a need for improved photoresponsive devices, and improved imaging systems utilizing such devices. Additionally, there continues to be a need for photoresponsive devices of varying sensitivity, which devices are economical to prepare and retain their properties over extended periods of time. Furthermore there continues to be a need for photoresponsive devices that permit both normal and reverse copying of black and white as well as full color images, especially in high speed digital printing systems.

In U.S. Pat. No. 4,410,616, to Griffiths, et al., issued Oct. 18, 1983, there is disclosed an improved ambi-polar photoresponsive device useful in imaging systems for the production of positive images, from either positive or negative originals, which device is comprised of: (a) supporting substrate, (b) a first photogenerating layer, (c) a charge transport layer, and (d) a second photogenerating layer, wherein the charge transport layer is comprised of a highly insulating organic resin having dissolved therein small molecules of an electrically active material of N,N'-diphenyl-N,N'-bis("X substituted" phenyl)-[1,1,-biphenyl]-4,4'-diamine wherein X is selected from the group consisting of alkyl and halogen. There is also disclosed an example of a first photogenerator layer with a red light sensitive material such as a phthalocyanine, and a second photogenerator layer with a blue light sensitive material, such as amorphous selenium, wherein a red highlight color image can be obtained when the ambi-polar device is charged positively, see column 7, lines 28–39.

In U.S. Pat. No. 5,405,709, Apr. 11, 1995, Littman, et al., there is disclosed an internal junction organic electroluminescent device comprised of, in sequence, an anode, an organic electroluminescent medium, and a cathode, the organic electroluminescent medium further comprising a hole injecting and transporting zone contiguous with the anode and an electron injecting and transporting zone contiguous with the cathode, the electron injecting and transporting zone further comprising an electron injecting layer in contact with the cathode, characterized in that the portion of the organic electroluminescent medium that is interposed between the electron injecting layer and the hole injecting and transporting zone is capable of emitting white light in response to hole-electron recombination and comprises a fluorescent material and a mixed ligand aluminum chelate of the formula $(R^s—Q)_2—Al—O—L$ where Q in each occurrence represents a substituted 8-quinolinolato ligand, $R^s$ represents an 8-quinolinolato ring substituent chosen to block sterically the attachment of more than two substituted 8-quinolinolato ligands to the aluminum atoms, O—L is a phenolato ligand, and L is a hydrocarbon group that includes a phenyl moiety. The compound 1,1-bis (di-4-tolylaminophenyl) cyclohexane (TAPC) is mentioned as a useful aromatic tertiary amine.

In U.S. Pat. No. 4,999,809, issued Mar. 12, 1991, Schildkraut, et al., there is disclosed a photorefractive device comprised of a first and second electrodes for establishing a potential gradient between first and second spaced locations and, interposed between the first and second electrodes, intermediate means capable of producing in a readout beam of electromagnetic radiation an image pattern corresponding to that present in a spatially intersecting writing beam of electromagnetic radiation when a potential gradient is applied to the intermediate means by said first and second electrodes. The intermediate means consists of a photorefractive layer capable of internally storing the image pattern of the writing beam created by its interference with an intersecting reference beam of electromagnetic radiation, the photorefractive layer being comprised of a homogeneous organic photoconductor containing organic noncentrosymmetric molecular dipoles capable of imparting to the photorefractive layer a second order polarization susceptibility of greater than $10^{-9}$ esu. The compound 1,1-bis (di-4-tolylaminophenyl) cyclohexane (TAPC) is also mentioned as a hole transporting agent, reference Example I.

In U.S. Pat. No. 5,876,887, issued Mar. 2, 1999, to Chambers, et al., there is disclosed an electrophotographic imaging member with a support, and at least one photoconductive layer having from about 90% by weight to about 10% by weight of the photoconductive particles of a photosensitive substituted perylene pigment, and, correspondingly, from about 10% by weight to about 90% by weight of at least one other n-type photosensitive pigment that is sensitive to shorter wavelength light than is the perylene pigment.

The aforementioned references are incorporated in their entirety by reference herein.

In the devices, imaging apparatuses, and processes of the prior art, various significant problems exist. For example, many conventional photoreceptor devices containing certain hole transport molecules (HTM) such as N,N'-diphenyl-N,N'-bis(3-methyl phenyl)-(1,1'-biphenyl)-4,4'-diamine (TPD) in an overlying charge transport layer cannot be successfully irradiated with specialized light sources, such as blue light generated from an aluminum-gallium-indium-nitride (AlGaInN) diode laser which source produces wavelength emissions, for example, of about 400 nanometers. This is because the certain hole transport molecules effectively absorb light at wavelengths below about 420 nanometers and thus prevent incident light from reaching the underlying charge generator layer. The application of a blue light diode laser irradiation source to electrophotographic imaging systems could potentially offer a number of significant and economic advantages, such as higher image resolution, improved print quality, and lower energy consumption. These and other advantages are enabled with the articles, apparatuses, and processes of the present invention.

There remains a need for articles, such as electroreceptors or photoreceptors, imaging apparatuses, and imaging processes which permits electrophotographic imaging systems to be efficiently and controllably irradiated with a blue light diode laser source.

SUMMARY

A Embodiments of the present invention, include:

A photoconductive imaging member comprising a supporting conductive substrate, an optional hole blocking layer, an optional adhesive layer, a charge transport layer, a charge generating layer, and an optional charge trapping layer.

an electrostatographic article comprising:

a substrate;

a charge generator layer overcoated on the substrate and which layer is sensitive to blue light; and a charge transport layer overcoated on the charge generator layer and which charge transport layer is transparent to blue light;

an electrophotographic article comprising: a blue light transparent transport layer which contains a charge transport component represented by:

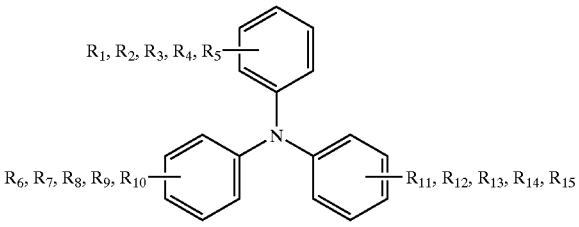

wherein R1 through R15 are selected from the group consisting of alkyl, alkoxy, other fused aromatic ring systems such as carbazole, stilbene and the like, and halogen. R1 through R15 can be chosen in such a way that at least one of R1 through R15 is alkoxy. In embodiments where R1–R15 are selected from the group consisting of alkoxy, the charge transport component is present in an amount of from about 10 to about 70 weight percent based on the total weight of the transport layer. The charge transport layer is transparent, or has 25% to 100% transmission between 390 nm and 450 nm. In specific embodiments the charge transport component is bis(3,4-dimethylphenyl)-4-methoxphenyl amine) and blue light sensitive generator layer which includes, for example, trigonal selenium;

an imaging process comprising:

irradiating the abovementioned imaging member with a diode laser at wavelength of from about 390 to about 450 nanometers;

developing the resulting latent image on the imaging member with a developer; and transferring the resulting developed image to a receiver member; and further including the formation of high resolution images and prints; and a printing machine comprising:

the abovementioned imaging member;

a diode laser light source adapted to produce wavelengths of from about 390 to about 450 nanometers to irradiate the imaging member and form a latent image on the imaging member;

a developer housing adapted to develop the latent image on the imaging member with a developer;

a receiver member adapted to receive the resulting developed image; and an optional fixing member adapted to fix the resulting developed and transferred image to the receiver member. The charge generator layer has an actinic photosensitivity in the range of from about 395 nm to about 405 nm.

The imaging member, imaging article, and processes thereof, of the present invention, may be used to create blue sensitive imaging devices that allow the use of 400 nanometer blue laser diodes as an exposure source. High resolution laser printers require pointwise exposure using the smallest possible diameter laser beam. The minimum size of a laser beam is governed by the limits imposed by diffraction from the optical elements in the laser delivery system. The minimum beam size at the photoreceptor surface for a given set of optical elements is directly proportional to the wavelength of the laser illumination. The beam size for a 400 nanometer laser diode would be approximately half that observed with the same hardware and a 780 nanometer laser diode.

An advantage of the present invention is that the article and processes thereof afford the following: higher resolution, higher print speed and a lower cost.

Figure 1:
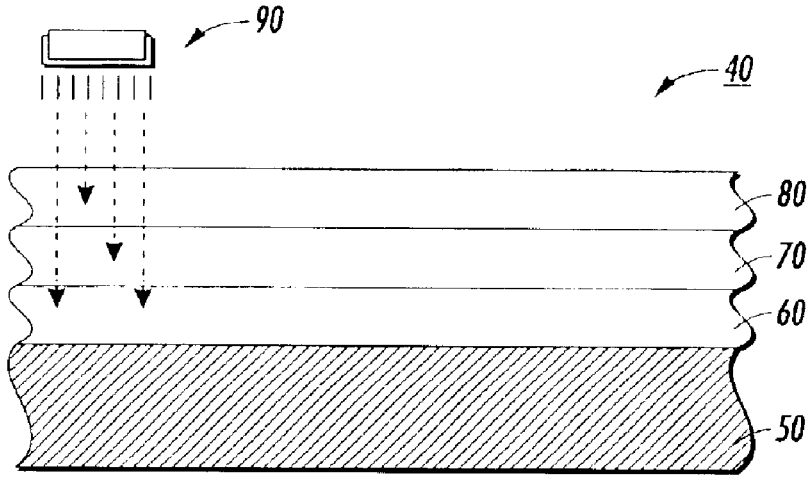
FIG. 1 illustrates a cross section of an exemplary layered imaging article of the present invention.

Referring to the FIGS., FIG. 1 illustrates a cross section of an exemplary layered imaging article 40 of the present invention including a substrate 50, a charge generator layer 60, a charge transport layer 70, and an optional overcoat layer 80, which article responds to as indicated in the above mentioned figures and as described herein when exposed to a suitable radiation source 90. The overcoat layer is transparent to blue light of from about 390 nanometers to about 430 nanometers.

Figure 2:
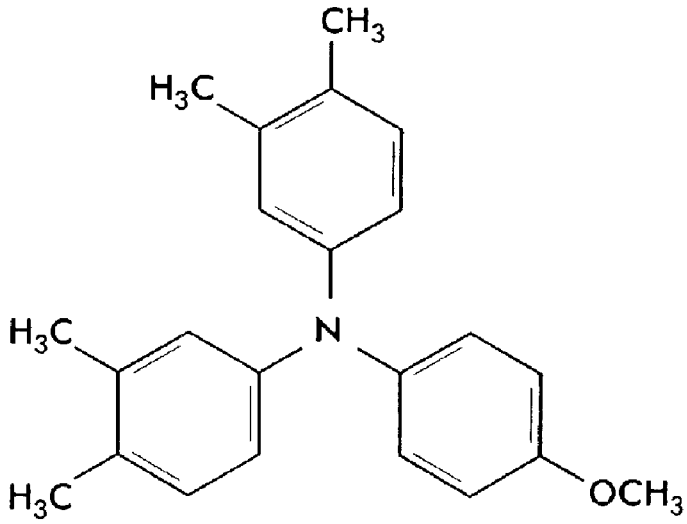
FIG. 2 shows the chemical structural formulas of hole transport molecule bis(3,4-dimethylphenyl)-4-methoxphyenyl amine).

FIG. 2 illustrates the chemical structural formulas of bis(3,4-dimethylphenyl)-4-methoxphyenyl amine).

Figure 3:
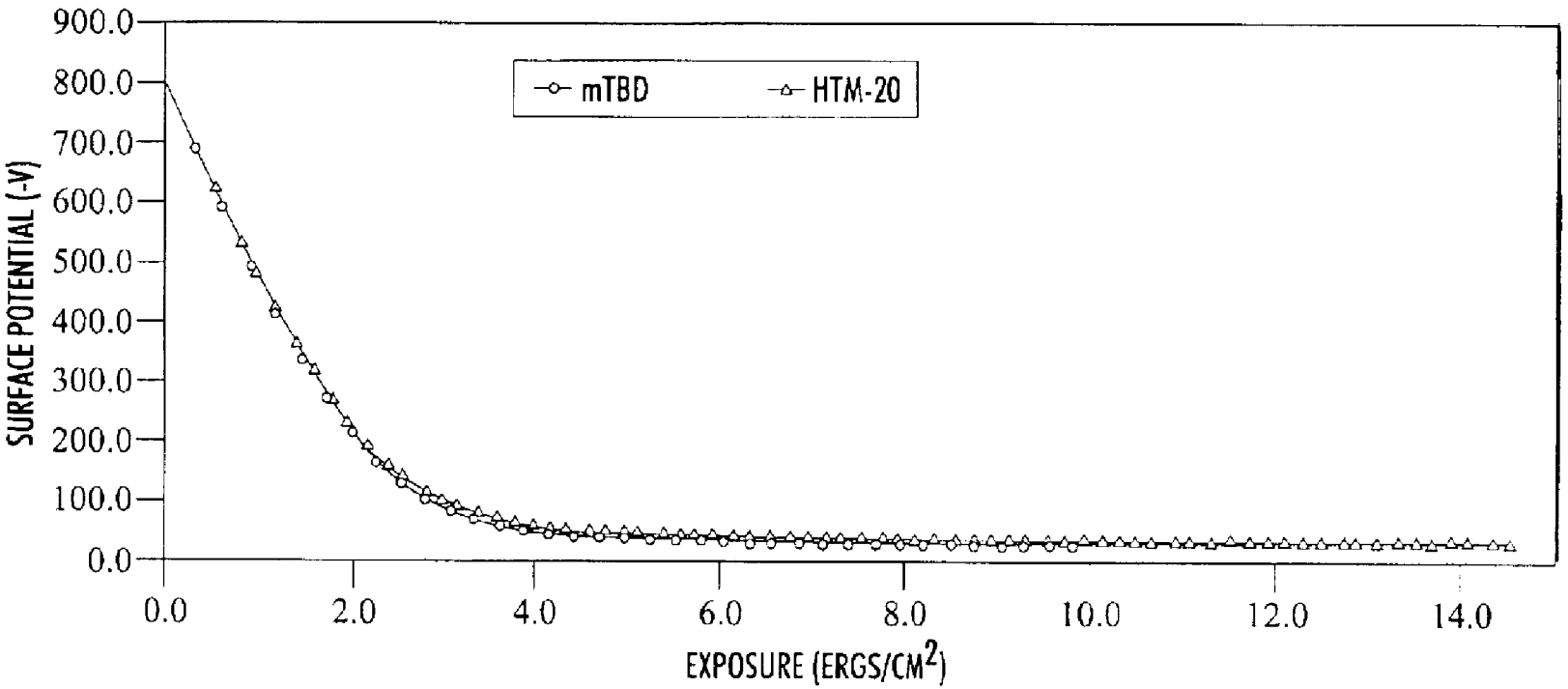
FIG. 3 illustrates the photon induced discharge curves (PIDC) of prototypical photoreceptor devices of the present invention with bis(3,4-dimethylphenyl)-4-methoxphyenyl amine) as the hole transport molecule in the charge transport layer as compared to the same device with N,N'-diphenyl-N,N'bis(3-methylphenyl)-[1,1'-biphenyl]-4,4'diamine, (m-TBD) as the hole transport molecule in the charge transport layer as a function of image potential in volts versus exposure energy in ergs per centimeters squared.

FIG. 3 illustrates the photon induced discharge curves (PIDC) measured at 670 and 400 nanometers of prototypical photoreceptor devices of the present invention having a background generator layer (BGL) that includes hydroxygallium phthalocyanine HOGaPc and with bis(3,4-dimethylphenyl)-4-methoxphyenyl amine) as the hole transport molecule in the charge transport layer and appears to provide a PIDC with a comparable profile compared to the same device with N,N'-diphenyl-N,N'bis(3-methylphenyl)-[1,1'-biphenyl]-4,4'diamine, (m-TBD) as the hole transport molecule in the charge transport layer as a function of image potential in volts versus exposure energy in ergs per centimeters squared.

The present invention is particularly desirable for electrophotographic imaging layers which comprise two electrically operative layers, a charge generating layer and a charge transport layer.

The substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be flexible, semi-rigid, or rigid, and may have any number of different configurations such as, for example, a sheet, a scroll, an endless flexible belt, a cylinder, and the like. The substrate may be in the form of an endless flexible belt which comprises a commercially available biaxially oriented polyester known as MYLAR™, MELINEX™, and KALADEX® available from E. I. du Pont de Nemours & Co.

The thickness of the substrate layer depends on numerous factors, including mechanical performance and economic considerations. The thickness of this layer may range from about 65 micrometers to about 150 micrometers, and in embodiments from about 75 micrometers to about 125 micrometers for optimum flexibility and minimum induced surface bending stress when cycled around small diameter rollers, for example, 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods.

The electrically conductive ground plane may be an electrically conductive metal layer which may be formed, for example, on the coating article or substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be from about 20 Angstroms to about 750 Angstroms, and more specifically from about 50 Angstroms to about 200 Angstroms for an optimum combination of electrical conductivity, flexibility and light transmission. Regardless of the technique employed to form the metal layer, a thin layer of metal oxide may form on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength of from about 4,000 Angstroms to about 9,000 Angstroms or a conductive carbon black dispersed in a plastic binder as an opaque conductive layer.

After deposition of the electrically conductive ground plane layer, the blocking layer may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable hole blocking layer polymer compositions are described in U.S.

Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. patents are incorporated herein by reference in their entirety.

The blocking layer is continuous and may have a thickness of less than about 10 micrometers because greater thicknesses may lead to undesirably high residual voltage. A hole blocking layer of from about 0.005 micrometers to about 1.5 micrometers is utilized in embodiments because charge neutralization after the exposure step is facilitated and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is in embodiments applied in the form of a dilute solution, with the solvent being removed after deposition of the coating by conventional techniques such as by vacuum, heating and the like. Generally, a weight ratio of blocking layer material and solvent of from about 0.05:100 to about 5:100 is satisfactory for spray coating.

Intermediate layers between the blocking layer and the adjacent charge generating or photogenerating layer may be desired to promote adhesion. For example, the adhesive layer may be employed. If such layers are utilized, they may have a dry thickness of from about 0.001 micrometers to about 0.2 micrometers. Typical adhesive layers include film-forming polymers such as polyester, DUPONT-49, 000™ resin, available from E. I. du Pont de Nemours & Co., VITEL-PE100™, available from Goodyear Rubber & Tire Co., polyvinylbutyral, polyvinylpyrrolidone, polyurethane, polymethyl methacrylate, and the like materials.

The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006, the disclosure of which is incorporated herein by reference in its entirety, wherein finely divided particles of a photoconductive inorganic compound are dispersed in an electrically insulating organic resin binder. Other well known electrophotographic imaging layers include amorphous selenium, halogen doped amorphous selenium, amorphous selenium alloys including selenium-arsenic, selenium-tellurium, selenium-arsenic-antimony, and halogen doped selenium alloys, cadmium sulfide and the like. Generally, these inorganic photoconductive materials are deposited as a relatively homogeneous layer.

Any suitable charge generating or photogenerating material may be employed as one of the two electrically operative layers in the multi-layer photoconductor embodiment of this invention. Typical charge generating materials include metal free phthalocyanine described in U.S. Pat. No. 3,357,989 such as x-metal free phthalocyanines, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename INDOFAST DOUBLE SCARLET, INDOFAST VIOLET LAKE B, INDOFAST BRILLIANT SCARLET and INDOFAST ORANGE. Other examples of charge generating layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507, the disclosures of which are incorporated herein by reference in their entirety.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. Nos. 3,121,006 and 4,439,507, the disclosures of which are totally incorporated herein by reference. Organic resinous polymers may be block, random or alternating copolymers. The photogenerating composition or pigment can be present in the resinous binder composition in various amounts. When using an electrically inactive or insulating resin, it is preferred that there be high levels of particle-to-particle contact between the photoconductive particle population. This condition can be achieved, for example, with the photoconductive material present, for example, in an amount of at least about 15 percent by volume of the binder layer with no limit on the maximum amount of photoconductor in the binder layer. If the matrix or binder comprises an active material, for example, poly-N-vinylcarbazole, the photoconductive material need only to comprise, for example, about 1 percent or less by volume of the binder layer with no limitation on the maximum amount of photoconductor in the binder layer. Generally for charge generator layers containing an electrically active matrix or binder such as poly-N-vinyl carbazole or phenoxy-poly(hydroxyether), from about 5 percent by volume to about 60 percent by volume of the photogenerating pigment is dispersed in about 40 percent by volume to about 95 percent by volume of binder, and in embodiments from about 7 percent to about 30 percent by volume of the photogenerating pigment is dispersed in from about 70 percent by volume to about 93 percent by volume of the binder. The specific proportions selected also depends to some extent on the thickness of the generating layer. The charge generator layer may contain a binder resin in an amount of from about 50 to about 99 weight percent based on the total weight of the charge generator layer.

The thickness of the photogenerating binder layer is not particularly critical. Layer thicknesses from about 0.05 micrometers to about 40.0 micrometers may be satisfactory. The photogenerating binder layer containing photoconductive compositions and/or pigments, and the resinous binder material in embodiments range in thickness of from about 0.01 micrometers to about 5.0 micrometers, and has an optimum thickness of from about 0.3 micrometers to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like. The charge generator layer may contain trigonal gelenium in an amount of from about 1 to about 25 weight percent based on the total weight of the charge generator layer.

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, for example, 4,000 Angstroms to 8,000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. The charge transport layer in conjunction with the generating layer is a material which is an insulator to the extent that an electrostatic charge placed on the transport layer is not conductive in the absence of illumination, that is, does not discharge at a rate sufficient to prevent the formation and retention of an electrostatic latent image thereon. Preferred transport components include triarylamines having an oxidation potential from about 0.3 to about 1.4 volts, more preferably from about 0.7 to about 0.9 volts. A preferred transport component is a triarylamine having an oxidation potential below about 0.80 volts.

In embodiments, a transport layer employed in the electrically operative layer in the photoconductor embodiment of this invention comprises from about 25 to about 75 percent by weight of at least one charge transporting aromatic amine compound, and about 75 to about 25 percent by weight of a polymeric film forming resin in which the aromatic amine is soluble. Examples of charge transporting aromatic amines for charge transport layer(s) capable of supporting the injection of photogenerated holes of a charge generating layer and transporting the holes through the charge transport layer include bis(3,4-dimethylphenyl)-4-methoxphyenyl amine). The charge transport layer binder resin can also be a polyester, a polycarbonate, a polyvinylbutyral, a polyethercarbonate, an aryl amine polymer, or styrene copolymer in an amount of from about 30 to about 90 weight percent based on the total weight of the transport layer.

Preferred charge transport components are selected from the group consisting of N,N'-diphenyl-N,N'-bis (alkylphenyl)-1,1'-biphenyl-4,4'-diamine wherein alkyl is selected from the group consisting of methyl, ethyl, propyl, butyl, hexyl, and the like; and N,N'-diphenyl-N,N'-bis (halophenyl)-1,1'-biphenyl-4,4'-diamine wherein the halo substituent is preferably a chloro substituent. Other specific examples of aryl amines include, 9-9-bis(2-cyanoethyl)-2, 7-bis(phenyl-m-tolylamino)fluorene, tritolylamine, N,N'-bis (3,4 dimethylphenyl)-N'(1-biphenyl) amine, 2-bis ((4'-methylphenyl) amino-p-phenyl) 1,1-diphenyl ethylene, and 1-bisphenyl-diphenylamino-1-propene. The charge transport layer may also include a mixture of bis(3,4-dimethylphenyl)-4-methoxphenyl amine) and N,N'-diphenyl-N,N'bis(3-methylphenyl)-[1,1'-biphenyl]-4, 4'diamine, in a relative weight ratio of from about 0.1:1 to about 1:0.1 and in a total amount of from about 10 to about 70 weight percent based on the total weight of the transport layer where said transport layer is transparent or 25 percent to 100 percent transmission between 390 nanometers and 450 nanometers.

Any polymer which forms a solid solution with the hole transport molecule is a suitable polymer material for use in forming a hole transport layer in a photoreceptor device. Any solvent which dissolves both the polymer and the hole transport molecule are suitable for use in fabricating photoreceptor devices of the present invention. Any suitable inactive resin binder soluble in methylene chloride or other suitable solvent may be employed. In embodiments, electrically inactive resin materials are polycarbonate resins which may have a molecular weight from about 20,000 to about 100,000, more specifically from about 50,000 to about 100,000. In specific embodiments the electrically inactive resin material is poly(4,4'-dipropylidene-diphenylene carbonate) with a molecular weight of from about 35,000 to about 40,000, available as LEXAN 145™ from General Electric Company; poly(4,4'-isopropylidene-diphenylene carbonate) with a molecular weight of from about 40,000 to about 45,000, available as LEXAN 141™ from the General Electric Company; a polycarbonate resin having a molecular weight of from about 50,000 to about 100,000, available as MAKROLON™ from Farbenfabricken Bayer A.G., a polycarbonate resin having a molecular weight of from about 20,000 to about 50,000 available as MERLON™ from Mobay Chemical Company and poly(4,4'-diphenyl-1,1-cyclohexane carbonate). Suitable binder resins also include polyester, polyvinylbutyral, polyethercarbonate, aryl amine polymers, and styrene copolymer. Any suitable and conventional technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infra-red radiation drying, air drying and the like. Generally, the thickness of the transport layer is from about 5 micrometers to about 50 microns, more preferably to 100 micrometers, but thicknesses outside this range can also be used. In general, the ratio of the thickness of the charge transport layer to the charge generating layer is in embodiments maintained from about 2:1 to 200:1 and in some instances as great as 400:1.

COMPARATIVE EXAMPLE I

A bis(3,4-dimethylphenyl)-4-methoxphenyl amine) containing charge transport layer was formed on a hydroxygallium phthalocyanine (HOGaPc) containing charge generating layer device. The photo induced discharge curves (PIDC) for were measured at 670 and 400 nanometers and are shown in FIG. 3.

EXAMPLE II

Photo-Transparency at 400 Namometers

To assess the photo-transparency or photo-transmission of potential hole transport molecules, four solutions were prepared with each solution containing a mixture of 50 weight percent of a hole transport molecule or mixture of two or more hole transport molecules and 50 weight percent MAKROLON® 5705 polycarbonate together as 15 weight percent solids in methylene chloride. The four hole transport molecules or hole transport molecule combinations selected for analysis were: tritolyamine TTA; 1,1-bis (di-4-tolylaminophenyl) cyclohexane (TAPC); TAPC:TPD=1:1; and N,N'-diphenyl-N,N'-bis(3-methyl phenyl)-(1,1'-biphenyl)-4,4'-diamine TPD. The solutions were coated to provide a film layer of 25 micrometers dry thickness on MYLAR® then dried at 125° C. for one minute. The films were removed from the MYLAR® substrate and the percent transmission was measured for the resulting free standing films. Both tritolyamine TTA and 1,1-bis (di-4-tolylaminophenyl) cyclohexane (TAPC) transmit at 400 nanometers.

Other modifications of the present invention may occur to one of ordinary skill in the art based upon a review of the present application and these modifications, including equivalents thereof, substantial equivalents, similar equivalents, and the like, are intended to be included within the scope of the present invention.

What is claimed is:

1. An electrostatographic article having an imaging member comprising:

a substrate;

a charge generator layer overcoated on the substrate and which layer is sensitive to blue light; and a charge transport layer overcoated on the charge generator layer and which charge transport layer is transparent to blue light and wherein the charge transport layer comprises a triarylamine having an oxidation potential from about 0.3 to about 1.4 volts, and of the general formula:

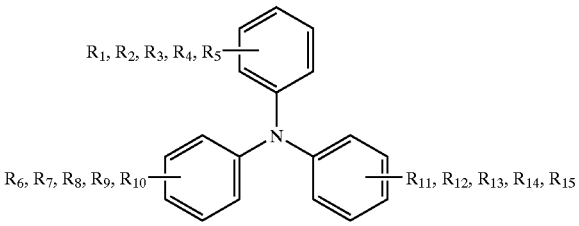

wherein R1 through R15 are independently selected from the group consisting of alkyl, alkoxy, fused aromatic ring systems and halogen, and wherein an electrically conductive support is provided and wherein said substrate is non-conductive.

2. An article in accordance with claim 1, wherein the charge generator layer includes at least one material selected from the group consisting of metal free phthalocyanine, copper phthalocyanine, vanadyl phthalocyanine, hydroxygallium phthalocyanine, trigonal selenium, bisazo compounds, quinacridones, substituted 2,4-diaminotriazines, and polynuclear aromatic quinones.

3. An article in accordance with claim 1, wherein the charge transport layer comprises a non-photoconductive material which supports the injection of photogenerated holes or electrons from the generator layer.

4. An article in accordance with claim 1, wherein R1 through R15 are independently selected from the group consisting of alkoxy, and wherein said triarylamine comprises an amount of from about 10 to about 70 weight percent based on the total weight of the transport layer and wherein said charge transport layer is transparent or has 25 percent to 100 percent transmission between 390 nanometers and 450 nanometers.

5. An article in accordance with claim 1, wherein the charge generator layer contains a binder resin in an amount of from about 50 to about 99 weight percent based on the total weight of the charge generator layer.

6. An article in accordance with claim 1, wherein the charge generator layer contains a charge generator material of trigonal selenium in an amount of from about 1 to about 25 weight percent based on the total weight of the charge generator layer.

7. An article in accordance with claim 1, wherein the charge transport layer further includes a binder resin.

8. An article in accordance with claim 7, wherein the charge transport layer binder resin is a polyester, a polycarbonate, a polyvinylbutyral, a polyethercarbonate an aryl amine polymer, or styrene copolymer in an amount of from about 30 to about 90 weight percent based on the total weight of the transport layer.

9. An article in accordance with claim 1, wherein said triarylamine has an oxidation potential of equal to or below about 0.8 volts.

10. An article in accordance with claim 1, wherein said triarylamine has an oxidation potential of from about 0.7 to about 0.9 volts.

11. An article in accordance with claim 1, further comprising an overcoat layer wherein the overcoat layer is transparent to blue light of from about 390 nanometers to about 430 nanometers.

12. An article in accordance with claim 1, wherein the charge generator layer comprises trigonal selenium, or hydroxygallium phthalocyanine.

13. An article in accordance with claim 1, wherein the charge generator layer includes hydroxygallium phthalocyanine.

14. An article in accordance with claim 1, wherein the charge generator layer has a film thickness of from about 0.01 microns to about 5 microns and the charge transport layer has a film thickness of from about 5 microns to about 50 microns.

15. An imaging process comprising:

irradiating the electrostatographic article of claim 1 with a diode laser at a wavelength of from about 390 nanometers to about 450 nanometers to form a latent image on the imaging member;

developing the resulting latent image on the imaging member with a developer resulting in a developed image; and transferring the resulting developed image to a receiver member.

16. A process in accordance with claim 15, wherein high resolution images are formed and printed.

17. A printing machine comprising:

an electrostatographic article in accordance with claim 1;

a diode laser light source adapted to produce wavelengths of from about 390 nanometers to about 450 nanometers to irradiate the imaging member and form a latent image on the imaging member;

a developer housing adapted to develop the latent image on the imaging member with a developer;

a receiver member adapted to receive the resulting developed image; and an optional fixing member adapted to fix the resulting developed and transferred image to the receiver member.

18. A printing machine in accordance with claim 17, wherein the charge generator layer of the electrostatographic article has an actinic photosensitivity in the range of from about 395 nanometers to about 405 nanometers.

19. An article according to claim 1, wherein the charge generator layer comprises photogenerating pigments.

20. An article according to claim 1, wherein the charge generator layer comprises photogenerating pigments selected from the group consisting of selenium, cadmium sulfide, vanadyl phthalocyanine, x-metal free phthalocyanine, benzimidazole perylene (BZP), hydroxygallium phthalocyanine (HOGaPc), and trigonal selenium dispersed in binder resin.

21. An article according to claim 1, wherein the fused aromatic ring systems are selected from the group consisting of carbazole and stilbene.

22. A photoconductive imaging member comprising a supporting conductive substrate, an optional hole blocking layer, an optional adhesive layer, a charge transport layer, a charge generating layer, and an optional charge trapping layer;

and wherein the charge transport layer comprises a triarylamine having an oxidation potential from about 0.3 to about 1.4 volts and having the general formula:

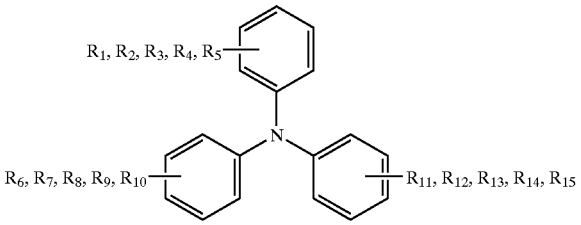

wherein R1 through R15 are independently selected from the group consisting of alkyl, alkoxy, fused aromatic ring systems and halogen.

* * * * *